United States Patent [19]

Levy et al.

[11] Patent Number: 4,559,732

[45] Date of Patent: Dec. 24, 1985

[54] METHOD OF APPLYING SIGNS

[75] Inventors: Leon A. Levy, Johannesburg, South Africa; Anthony Matthews, London, England

[73] Assignee: Klingshield South Africa (Proprietary) Limited, Johannesburg, South Africa

[21] Appl. No.: 502,608

[22] Filed: Jun. 9, 1983

[30] Foreign Application Priority Data

Jun. 9, 1982 [ZA] South Africa ..... 82/4053

[51] Int. Cl.[4] ..... G09F 7/16

[52] U.S. Cl. ..... 40/595; 434/88

[58] Field of Search ..... 40/595, 594, 584; 434/88; 156/62

[56] References Cited

U.S. PATENT DOCUMENTS

| | | | |
|---|---|---|---|
| 1,106,340 | 8/1914 | Bellamy | 40/595 |
| 3,315,387 | 4/1967 | Heuser | 40/595 |
| 3,324,574 | 6/1967 | Markley | 434/88 |

FOREIGN PATENT DOCUMENTS

| | | | |
|---|---|---|---|
| 476198 | 8/1951 | Canada | 40/594 |
| 1510249 | 1/1968 | France | 40/594 |

OTHER PUBLICATIONS

Emenee Electric "Enlarg-A-Graph" 1964 Catalogue.

*Primary Examiner*—Gene Mancene
*Assistant Examiner*—Cary E. Stone
*Attorney, Agent, or Firm*—Browdy and Neimark

[57] ABSTRACT

A method of applying a sign to a translucent or transparent panel such as a glass frontage of a shop. The method comprises applying a film of material onto one side of the panel, providing a mirror image of the sign visible on the film to a viewer on the one side of the panel, making cuts in the film corresponding to the mirror image and removing from the panel areas of the film so cut as to leave behind on the panel areas of the film forming the sign. The sign is intended to be seen from the other side of the panel.

7 Claims, 3 Drawing Figures

METHOD OF APPLYING SIGNS

BACKGROUND OF THE INVENTION

This invention relates to a method of applying signs, more particularly, but not exclusively, to a method of applying signs to windows or glass frontages of shops, offices and the like.

Signs of this kind are conventionally applied by using paint or gold or silver leaf. The latter provides an excellent finish but is expensive because of the high cost of metals used.

In recent years films of plastics material have been developed which can be applied to glass panes to alter characteristics of the glass such as light transmissibility, insulation and shattering.

SUMMARY OF THE INVENTION

It is an object of the invention to provide a novel method of applying signs in which such films are used and which is relatively inexpensive and effective.

According to the invention, a method of applying a sign to a translucent or transparent panel comprises applying a film of material onto one side of the panel, providing a mirror image of the sign visible on the film to a viewer on the said one side of the panel, making cuts in the film corresponding to the mirror image and removing from the panel areas of the film so cut so as to leave behind on the panel areas of the film forming the sign.

Further according to the invention the film is translucent or transparent to a viewer on the said one side of the panel, the mirror image of the sign being provided on the other side of the panel so as to be visible to a viewer on the said one side of the panel.

Further according to the invention the mirror image of the sign is located on the other side of the panel by attaching temporarily to the said other side of the panel a sheet of material carrying the mirror image.

Further according to the invention the sheet of material is translucent or transparent, an image of the sign being provided on one side of the sheet so as to provide the said mirror image of the sign when viewed from the other side of the sheet, the sheet being attached temporarily to the panel with its said other side facing the panel.

Further according to the invention the image of the sign is drawn or traced onto the sheet of material.

Further according to the invention the image, if traced, is traced from a projection thereof projected onto a suitable surface.

Further according to the invention the film of material is a film of self-adhesive plastics material which is laid onto the panel.

Further according to the invention the cuts in the film are made by hand using a sharp instrument.

A preferred embodiment of the invention is described below with reference to accompanying drawings in which:

DESCRIPTION OF THE PREFERRED EMBODIMENT(S)

In this embodiment of the invention a sign of letters EF in a rectange is to be applied to a translucent or transparent pane of glass 1 which may be the frontage of a shop, office or the like. The sign is intended to be seen by a viewer on the side 1*a*, i.e. the outside, of the pane of glass 1. The other side thereof, i.e. the inside, is designated 1*b*.

First, a film of material 2 is applied to the inside 1*b* of the pane of glass 1. The film of material 2 is transparent or translucent to a viewer on the inside 1*b* of the pane of glass. A suitable film of material 2 which may be used is plastics material which is today commercially available and which is provided with adhesive on one side thereof to enable it to be laid onto the glass to adhere thereto. This type of film is often opaque to a viewer on the outside 1*a* of the glass and translucent to a viewer on the inside. Others are translucent to a viewer on either side of the glass. Examples of trade names under which films of this kind are sold are "SUN GUARD", "NUN SUN", "LUMAR", "REFLECTO SHIELD" and "MACAL".

Figure 1:
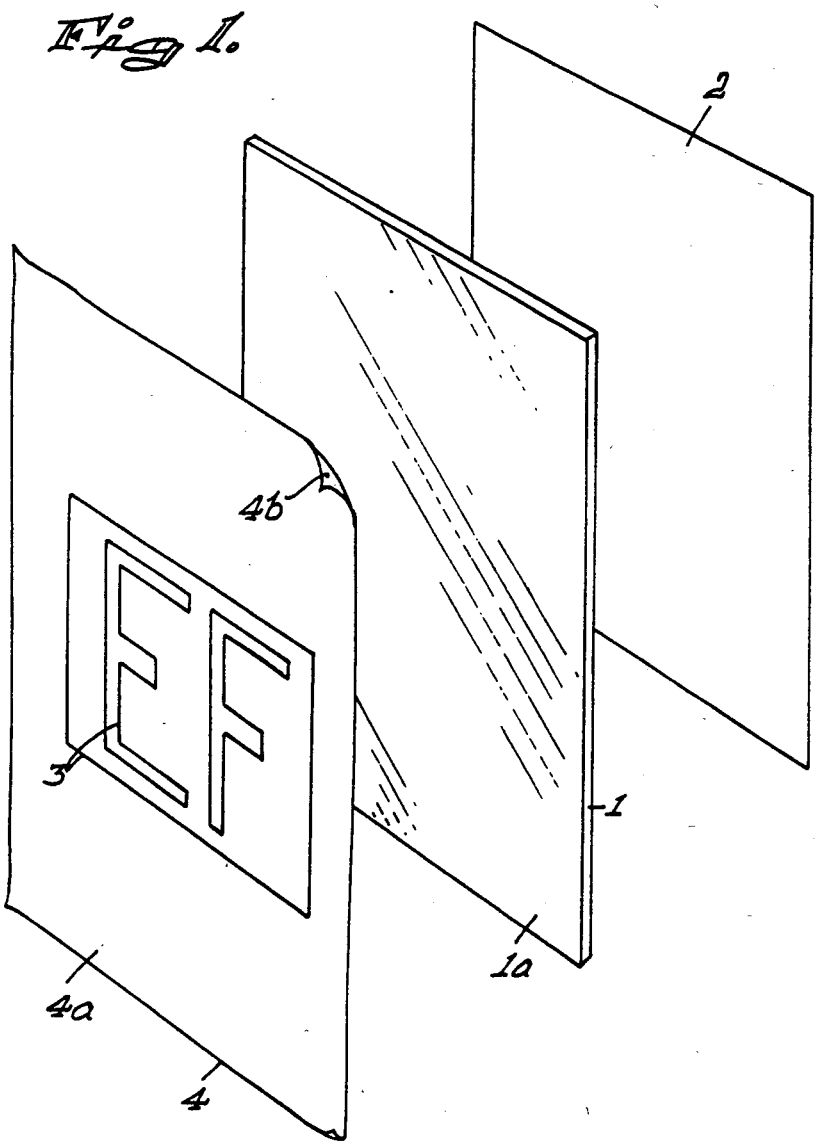
FIGS. 1 and 2 illustrate steps in applying a sign according to the invention to a pane of glass.
Figure 2:
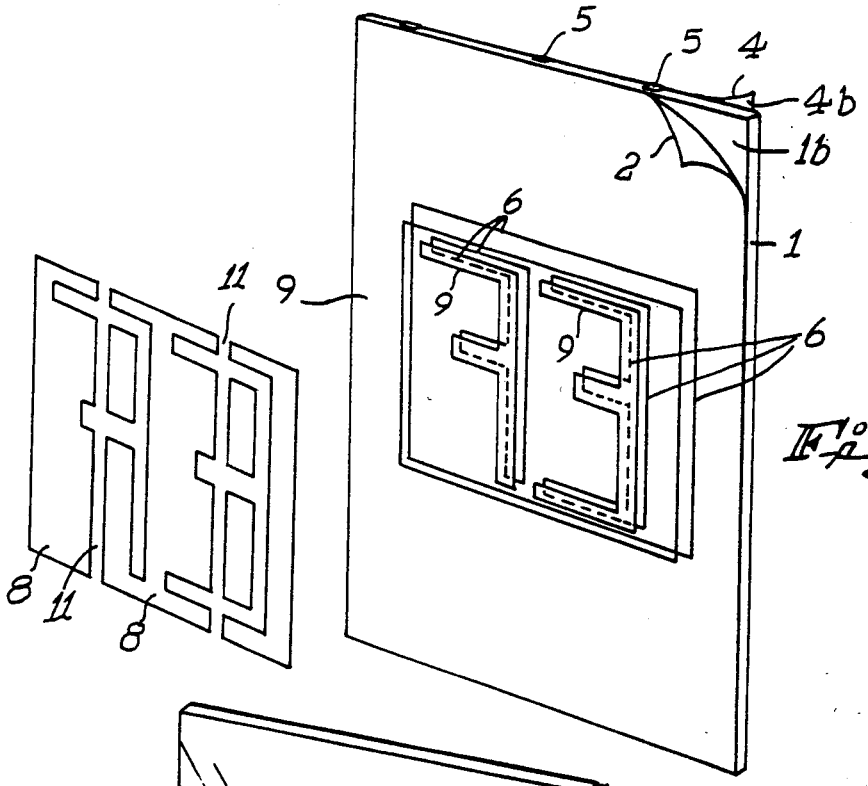
Figure 3:
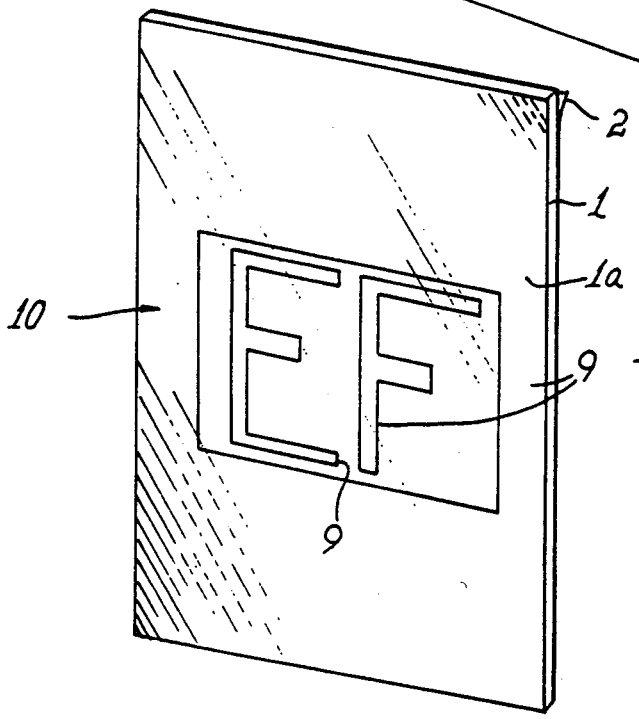
FIG. 3 shows the finished sign on the pane of glass.

The films are often applied to glass frontages of shops, offices and the like to alter characteristics of the glass such as light transmissibility, insulation and shattering. The films are usually supplied with a backing (not shown) covering the adhesive. The pane of glass 1 is first cleaned thoroughly whereafter the backing is removed from the film 2 which is then laid on the glass. Mostly a soap and water solution is first sprayed onto the adhesive before laying the film 2 on the glass. The soap and water solution activates the adhesive and allows the film to be moved on the glass to its correct position before the adhesive dries. A squeegee or the like is then used to remove air bubbles between the film of material 2 and the pane of glass 1. Next, a mirror image of the sign to be applied to the pane of glass must be provided so as to be visible on the film of material 2 to a viewer on the side 1*b* of the pane of glass. This is achieved in this embodiment of the invention by providing an image 3 of the sign on one side 4*a* of a sheet of translucent tracing paper 4 so that a mirror image of the sign is seen on the opposite side 4*b* of the tracing paper when viewed from the side 4*b*. The sheet of tracing paper 4*b* is then temporarily attached to the pane of glass 1 with the side 4*b* of the tracing paper 4 facing the outside 1*a* of the glass. The attachment may be made by any suitable means such as strips of masking tape 5. The mirror image 6 of the sign will now be visible through the pane of glass 1 and through the film of material 2 to a viewer on the inside 1*b* of the pane of glass as shown in FIG. 2.

The image 3 of the sign may be provided on the tracing paper 4 prior to its attachment to the pane of glass in any convenient manner. It may, for example, be drawn thereon or it may be traced thereon from a projection of the image projected onto a suitable surface. For example an episcope, epidiascope or an overhead projector may be used, as circumstances require, to project an image, enlarged as required, onto a blank surface and the tracing paper may be laid over the surface to enable the image to be traced thereon.

Next, cuts are made in the film of material 2 corresponding to the mirror image 6 as seen on the film of material to a viewer on the inside 1*b* of the pane of glass 1. The cuts may be made by hand using any suitable sharp instrument (not shown) and in this embodiment of the invention a suitable ruler (not shown) would also be required to guide the sharp instrument. Once the cuts have been made, areas 8 of the film of material 2 are removed from the pane of glass 1 so as to leave behind thereon areas 9 of the film of material 2 forming the required sign 10. In order to facilitate removal of the waste areas 8 of the film of material 2, additional cuts, for example those indicated by numeral 11 may be made therein prior to its removal from the glass.

The last step in applying the sign 10 is to remove the sheet of tracing paper 4 from the pane of glass 1.

The invention is not limited to the application of signs such as the sign 10 described above. Any sign consisting of dark and light areas can be applied. For example, the face of a person may be drawn to consist of areas of shadow and light. Cuts will be made along lines defining these areas and either the areas of shadow or the areas of light will be removed to form the face of the person.

Other embodiments of the invention may be made differing in matters of detail only from the embodiment described above and without departing from the scope of the invention described in the appended claims.

We claim:

1. A method of applying a sign to a translucent panel comprising;

applying a film of material onto one side of the panel, the film of material being translucent to a viewer on said one side of the panel, providing a mirror image of the sign on the other side of the panel, the mirror image of the sign being visible on the film to a viewer on said one side of the panel, making cuts in the film corresponding to the mirror image, removing the mirror image, and removing from the panel areas of the film so cut so as to leave behind on the panel areas of the film forming the sign when viewed from said other side of the panel.

2. A method according to claim 1 in which the mirror image of the sign is located on the other side of the panel by attaching temporarily to the said other side of the panel a sheet of material carrying the mirror image.

3. A method according to claim 2 in which an image of the sign is provided on one side of the sheet so as to provide the said mirror image of the sign when viewed from the other side of the sheet, the sheet being attached temporarily to the panel with its said other side facing the panel.

4. A method according to claim 3 in which the image of the sign is drawn onto the sheet of material.

5. A method according to claim 4 in which the image is traced from a projection thereof projected onto a suitable surface.

6. A method according to claim 1 in which the film of material is a film of self-adhesive plastics material which is laid onto the panel.

7. A method according to claim 1 in which the cuts in the film are made manually.

* * * * *